US006907220B2

(12) United States Patent
Mitsuya et al.

(10) Patent No.: US 6,907,220 B2
(45) Date of Patent: Jun. 14, 2005

(54) COOLING DEVICE FOR COOLING RECORDING SHEET

(75) Inventors: Teruaki Mitsuya, Hitachinaka (JP); Takashi Suzuki, Hitachinaka (JP); Heigo Ueki, Hitachinaka (JP); Daisuke Hara, Hitachinaka (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 50 days.

(21) Appl. No.: 10/452,642

(22) Filed: Jun. 3, 2003

(65) Prior Publication Data

US 2003/0228180 A1 Dec. 11, 2003

(30) Foreign Application Priority Data

Jun. 6, 2002 (JP) ..... P2002-165176

(51) Int. Cl.[7] ..... G03G 15/20
(52) U.S. Cl. ..... 399/328; 399/341
(58) Field of Search ..... 399/320, 328, 399/329, 341; 219/216; 432/60

(56) References Cited

U.S. PATENT DOCUMENTS

| | | | | | |
|---|---|---|---|---|---|
| 3,948,215 | A | * | 4/1976 | Namiki | 399/328 |
| 4,992,833 | A | * | 2/1991 | Derimiggio | 219/216 |
| 5,089,857 | A | * | 2/1992 | Xydias | 399/320 |
| 6,370,352 | B1 | * | 4/2002 | Tomita | 399/328 |

FOREIGN PATENT DOCUMENTS

| | | |
|---|---|---|
| JP | 4-260065 | 9/1992 |
| JP | 11-15308 | 1/1999 |

* cited by examiner

*Primary Examiner*—William J. Royer
(74) *Attorney, Agent, or Firm*—McGuireWoods LLP

(57) ABSTRACT

A cooling device used in an electrophotographic image forming device includes a cooling roller, which is a heat roller, and a backup roller pressed against the cooling roller to form a nip portion therebetween. After being discharged from a fixing device that thermally fixes a toner image onto a recording sheet, the recording sheet passes through the nip portion, whereby the cooling roller cools the recording sheet. The cooling roller is maintained at 100° C. or higher.

10 Claims, 2 Drawing Sheets

COOLING DEVICE FOR COOLING RECORDING SHEET

BACKGROUND OF THE INVENTION

1. Field of the Invention

The present invention relates to a recording sheet, and specifically to a cooling device that cools a recording sheet after the recording sheet was thermally fixed with a toner image.

2. Related Art

An electrophotographic printing device performs a developing process for developing visible images using colored particles on a surface of a recording sheet and a fixing process for fixing the visible images onto the surface of the recording sheet. Usually, toner in powder form designed to be suitable for electrophotographic printing devices is used as such colored particles. The toner fuses upon heating and fixes upon cooling. The electrophotographic printing device fixes toner images onto a recording sheet by thermal fusion by utilizing such property of the toner in the fixing process.

One type of conventional fixing device used in such an electrophotographic printing device includes a heat roller and a backup roller pressed against the heat roller. The heat roller and the backup roller are collectively referred to as fixing rollers. The heat roller is for generating heat and includes a metal body, which is a hollow tube formed of aluminum, and a heater housed in the metal body. Usually, a halogen lamp is used as the heater. The backup roller serves as a supporting roller and includes a metal shaft coated with a resilient layer, which deforms when pressed against the heat roller, thereby forming a nip portion.

When a recording sheet with a toner image formed thereon passes through the nip portion between the heat roller and the backup roller, pressure and heat are applied to toner forming the image, fusing and deforming the toner. As a result, the toner is fixed onto the surface of the recording sheet. This fixing method is called a heat roller fixing method. Here, only at least one of the two fixing rollers needs to generate heat.

When the recording sheet passes through the nip portion, the toner image contacts the heat roller. Accordingly, there is a danger that fused toner clings onto the surface of the heat roller, which is called offset phenomenon. If offset phenomenon occurs, toner clinging on the surface of the heat roller may be transferred onto a recording sheet during a subsequent fixing process, adversely affecting the printing result.

In order to overcome such a problem, the metal body of the heat roller is usually coated with a mold-releasing layer formed of fluoric resin, fluorine-containing rubber, or silicon rubber. Especially, the fluoric resin is well known in its excellent performance as a mold-releasing member, and so polytetrafluoroethylene (PTFE), perfluoroalkoxy (PFA), and the like are well used. Also, an exfoliation claw is attached to the heat roller for stripping the recording sheet off the heat roller.

The recording sheet and the toner fixed onto the recording sheet have substantially the same temperature as the heat roller when the recording sheet is discharged from the nip portion between the fixing rollers. Thereafter, the recording sheet gets cooled down while being transported through a sheet feed path, and then the recording sheet is discharged onto a sheet stacker. However, if the temperature of the recording sheet has not decreased to a glass transition temperature (Tg) before the recording sheet reaches the sheet stacker, then a toner-stick problem occurs.

That is, the fused toner is not completely fixed at a temperature higher than a glass transition temperature of the toner. If recording sheets are stacked one on the other in this condition, then the unfixed toner on a front surface of a recording sheet will stick to a rear surface of another recording sheet stacked thereon. As a result, unnecessary images may be formed on the rear surface of the adjacent sheet, or a part of image may be lost from the recording sheet, due to transfer of toner from the recording sheet to the adjacent sheet. In this manner, image quality may be degraded.

This problem occurs more likely in a high-speed printing device in which sufficient time is not always secured for allowing the recording sheet to cool down after being discharged before being discharged onto the sheet stacker.

In order to overcome such a tone-stick problem, there has been proposed to cool a recording sheet by providing a fan that blows air to the recording sheet. There has been also proposed to dispose a blower for lowering the internal temperature of the sheet stacker by supplying cool outside air into the sheet stacker. However, the fan and blower are disadvantageous in generating noise.

Japanese Patent-Application Publication No. HEI-4-260065 proposes to cool a recording sheet by brining the recording sheet into contact with a cooling roller on a downstream side of the fixing rollers. A heat pipe is used as the cooling roller. A recording sheet may pass through a nip portion between the cooling roller and a resilient support roller resiliently pressed against the cooling roller. Alternatively, the recording sheet may pass through a nip portion between the cooling roller and a belt in contact with the cooling roller.

Since moisture contained in a recording sheet evaporates when the recording sheet is heated, the humidity in the recording device increases when the fixing operation is performed to thermally fix the toner image. Using the cooling roller maintained at a cool temperature makes easier to effectively cool the recording sheet. However, using the cooling roller in such a high-humid environment causes dew condensation on the surface of the cooling roller. This causes errors in sheet transport operations and printing operations.

In order to prevent dew condensation on the cooling roller, Japanese Patent-Application Publication (Kokai) No. HEI-11-15308 proposes to dispose an duct above a cooling roller for ventilating a printing device by supplying outside air to the cooling roller. However, this necessitates a space for disposing a large duct and also a blower for generating air current through the duct, increasing the size of the printing device.

SUMMARY OF THE INVENTION

In view of the foregoing, it is an object of the present invention to overcome the above problems, and also to provide a compact-sized cooling device for cooling recording sheets while preventing dew condensation.

In order to attain the above and other objects, the present invention provides a cooling device used in an image forming device that forms images on a recording medium and thermally fixes the images on the recording medium. The cooling device includes a cooling roller and a support member that contacts the cooling roller to define a nip portion between the cooling roller and the support member. The cooling roller cools a recording medium at the nip portion sandwiched between the cooling roller and the support member. The temperature of the cooling roller is set to equal to or greater than 85° C.

There is also provided a cooling device used in an image forming device that forms images on a recording medium and thermally fixes the images on the recording medium. The cooling device includes a cooling roller and a support member that contacts the cooling roller to define a nip portion between the cooling roller and the support member. The cooling roller cools a recording medium at the nip portion between the cooling roller and the support member. A temperature coefficient of the cooling roller is set to 0.73 or greater, the temperature coefficient being equal to $(T_{in}-T_{out})/(T_{in}-T_c)$ wherein $T_{in}$ is a temperature of the recording medium when entering the nip portion, $T_{out}$ is a temperature of the recording medium when leaving the nip portion, and $T_c$ is the temperature of the cooling roller.

There is also provided an image forming device including an image forming unit that forms images on a recording medium, a fixing unit that thermally fixes the images on the recording medium, and a cooling device that cools the recording medium. The cooling device includes a cooling roller and a support member that contacts the cooing roller to define a nip portion between the cooling roller and the support member. The cooling roller cools a recording medium at the nip portion sandwiched between the cooling roller and the support member. The temperature of the cooling roller is set to equal to or greater than 85° C.

PREFERRED EMBODIMENT OF THE PRESENT INVENTION

Next, an embodiment of the present invention will be described with reference to the accompanying drawings.

Figure 1:
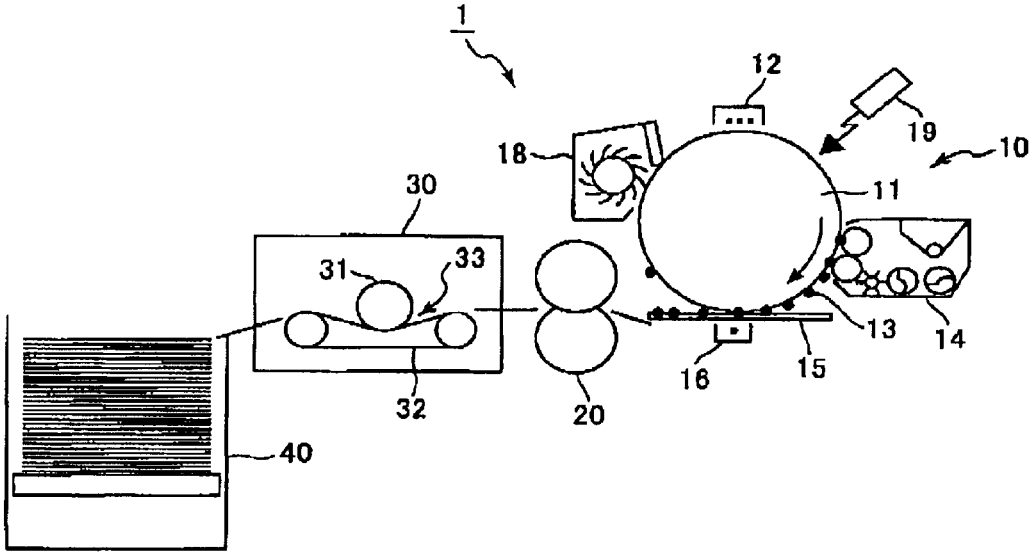
FIG. 1 is a plan view of an electrophotographic printing device according to a first embodiment of the present invention.

FIG. 1 shows an electrophotographic printing device that uses a cooling device according to an embodiment of the present invention. As shown in FIG. 1, an electrophotographic printing device 1 includes an image forming unit 10, a pair of fixing rollers 20, a cooling device 30, and a sheet stacker 40, disposed from an upstream side to a downstream side in this order with respect to a sheet feed direction in which a recording sheet 15 is transported.

The image forming unit 10 includes a photosensitive drum 11, a charging unit 12, a developing unit 14, a transfer unit 16, a cleaner 18, and a light source 19. The charging unit 12 uniformly charges a surface of the photosensitive drum 11 to a uniform charge. The light source 19 includes a semiconductor laser and a light system controlled by a control unit, such as a laser driver (not shown). A light output from the light source 19 forms an electrostatic latent image on the surface of the photosensitive drum 11. When the electrostatic latent image comes into confrontation with the developing unit 14, then the developing unit 14 selectively supplies toner 13 to the surface of the photosensitive drum 11, thereby forming a visible toner image corresponding to the electrostatic latent image. When the toner image reaches a transfer position where the photosensitive drum 11 confronts the transfer unit 16 via the recording sheet 15, the toner image is transferred onto the recording sheet 15. The cleaner 18 is for removing residual toner from the photosensitive drum 11 after the toner image has been transferred onto the recording sheet 15.

The recording sheet 15 with the toner image transferred thereon is supplied to a nip portion defined between the pair of fixing rollers 20, whereby the toner image is thermally fixed onto the recording sheet 15. Here, one of the pair of fixing rollers 20 is a heat roller that generates heat and the other is a pressure roller that presses against the heat roller to generate the nip portion therebetween.

Afterwards, the recording sheet 15 is supplied into the cooling device 30. The cooling device 30 includes a cooling roller 31 and a backup belt 32, together defining a nip portion 33 therebetween. The cooling device 30 cools the recording sheet 15 as the recording sheet 15 passes through the nip portion 33. After discharged from the cooling device 30, the recording sheet 15 is discharged into the sheet stacker 40. In this manner, an image forming process completes.

The toner 13 used in this embodiment has a glass transition temperature (Tg) of approximately 60° C. Therefore, it is necessary to decrease the temperature of the recording sheet 15 to less than 60° C. before the recording sheet 15 is discharged into the sheet stacker 40.

The recording sheet 15 used in this embodiment is a A4-size recording sheet having a ream weight of 55 kg, which is a recording sheet having a minimum heat capacity among various recording sheets that the electrophotographic printing device 1 of the present embodiment can print on. In order to lower the temperature of the recording sheet 15 to 60° C. or less before the recording sheet 15 is stacked in the sheet stacker 40, it is necessary to remove 130W of heat from the recording sheet 15 after the recording sheet 15 is discharged from the fixing rollers 20 before reaching the sheet stacker 40. In this embodiment, the cooling roller 31 is configured to have a cooling capacity of 150W to have some leeway.

Figure 2:
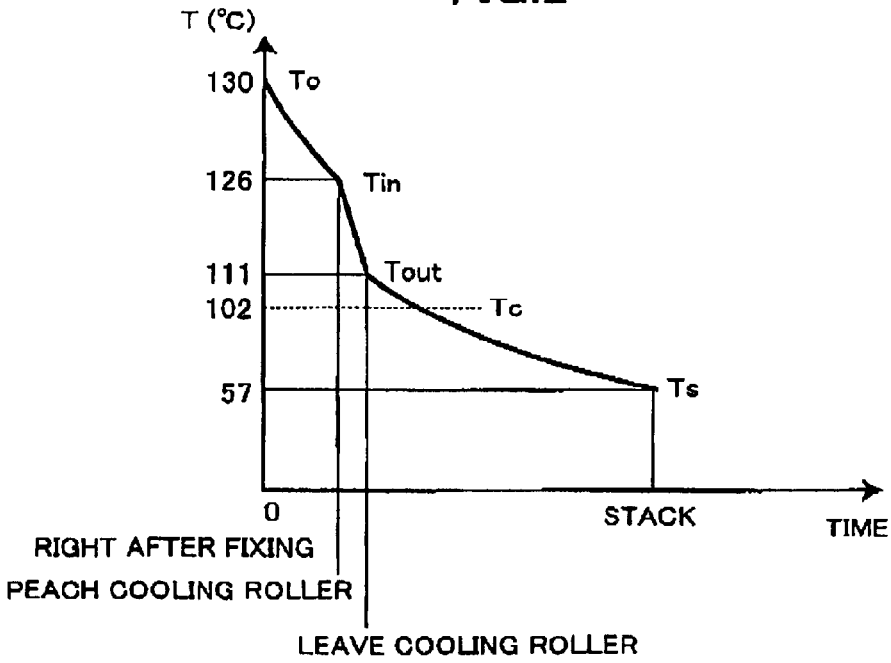
FIG. 2 is a graph showing change in temperature of a recording sheet after being discharged from fixing rollers according to the first embodiment of the present invention.

FIG. 2 shows a graph showing change in the temperature of the recording sheet 15 after being discharged from the fixing rollers 20. The vertical axis represents an average temperature of the recording sheet 15 in its thickness direction, and the horizontal axis represents time. As shown, the recording sheet 15 has a temperature $T_o$ immediately after the fixing operation was performed by the fixing rollers 20, a temperature $T_{in}$ when entering the nip portion 33 between the cooling roller 31 and the backup belt 32, a temperature $T_{out}$ when leaving the nip portion 33, and a temperature $T_s$ when discharged into the sheet stacker 40. The cooling roller 31 is maintained at a temperature $T_c$.

In the present embodiment, the recording sheet 15 has the temperature $T_o$ of 130° C. and the temperature $T_{in}$ of 126° C. The cooling roller 31 is set to the temperature $T_c$ of 102° C. The cooling roller 31 cools the recording sheet 15 by 15° C., so that the recording sheet 15 has the temperature $T_{out}$ of 111° C. As a result, at the time of reaching the sheet stacker 40, the recording sheet 15 has the temperature $T_s$ of 57° C., which is less than the glass transition temperature of 60° C. of the recording sheet 15. Therefore, there is no danger of the toner stick problem.

With the above configuration, dew condensation does not occur on the surface of the cooling roller 31 for the following reason.

Dew condensation occurs when the humidity in the electrophotographic printing device 1 is higher than the saturated vapor amount for the temperature $T_c$ of the cooling roller 31.

In this embodiment, the temperature $T_{out}$ is greater than the temperature $T_c$ and less than the temperature $T_{in}$ as described above ($T_{in}>T_{out}>T_c$). Atmospheric temperature $T_r$ surrounding the cooling roller 31 is affected by the temperature of the recording sheet 15, and is greater than the temperature $T_{out}$ and lower than the temperature $T_r$ ($T_{in}>T_r>T_{out}$). Therefore, the atmospheric temperature $T_r$ is greater than the temperature $T_c$ of the cooling device 30 ($T_c<T_r$). Accordingly, the moisture content of the ambient air surrounding the cooling roller 31 is less than the saturated vapor amount of the atmospheric temperature $T_r$.

If the moisture content of the ambient air is less than the saturated vapor amount of the temperature $T_c$ of the cooling roller 31, then no dew condensation occurs. That is, if the temperature $T_c$ of the cooling roller 31 is higher, then the dew condensation occurs less likely. Also, because a pressure surrounding the cooling roller 31 will never exceed the atmospheric pressure (1013.25 hPa), if the temperature $T_c$ of the cooling roller 31 is 100° C. or greater, then the saturated vapor pressure is maintained greater than the atmospheric pressure, and thus no dew condensation occurs.

Because the temperature $T_c$ of the cooling roller 31 is set to 120° C. in this embodiment, there is no fear of dew condensation. Accordingly, it is possible to decrease the temperature of the recording sheet 15 to 60° C. or less before the recording sheet 15 reaches the sheet stacker 40 while preventing dew condensation on the cooling roller 31 without providing a ventilation system to the cooling device 30.

Next, a cooling device according to a second embodiment of the present invention will be described. It should be noted that the components of the electrophotographic printing device 1 of the present embodiment identical to that of the first embodiment will be assigned with the same numberings and detailed description thereof will be omitted.

In this embodiment, the recording sheet 15 is transported faster than in the first embodiment. Therefore, the time duration to transport the recording sheet 15 from the fixing rollers 20 to the sheet stacker 40 is shorter than that of the first embodiment. Accordingly, it is necessary for the cooling device 30 to remove a greater amount of heat from the recording sheet 15 in order to achieve the temperature of 60° C. or less before the recording sheet 15 reaches the sheet stacker 40.

In this embodiment, it is necessary to remove 260 W heat from the A4-size recording sheet 15 having the ream weight of 55 kg after the recording sheet 15 is discharged from the fixing rollers 20 before reaching the sheet stacker 40. The cooling device 30 of the present embodiment is configured to have a cooling capacity of 300W to have some leeway.

Figure 3:
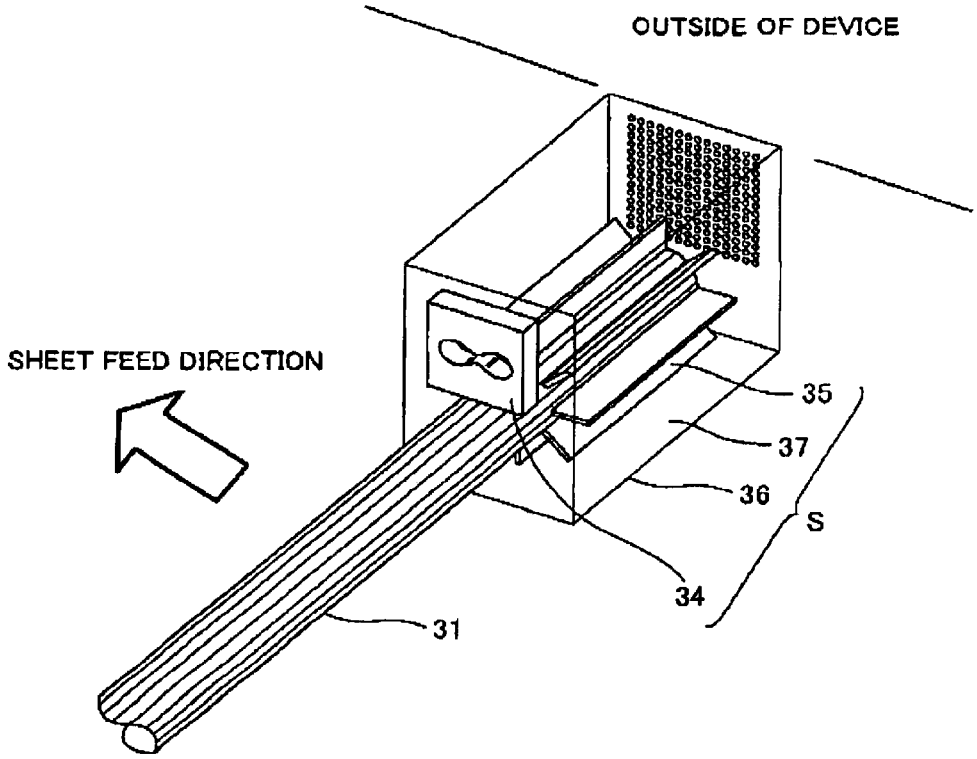
FIG. 3 is a perspective view of components of a cooling device according to a second embodiment of the present invention.

The cooling device 30 of the present embodiment is similar to that of the first embodiment but differs in that the cooling device 30 of the present embodiment further includes a ventilation system S shown in FIG. 3. The ventilation system S does not include a large-scale ventilation device for taking in outside air, but includes a ventilation fan 34, radiation fins 35, and a casing 36 defining a radiation room 37. The ventilation fan 34 is disposed to the side of the cooling roller 31 to take air into the radiation room 37 from a sheet-pass area, through which the recording sheet 15 is transported.

The ventilation fan 34 blows air to the radiation fins 35, which are housed inside the radiation room 37 and attached to the cooling roller 31. In this manner, the ventilation system S facilitates the cooling roller 31 to radiate heat so as to maintain the cooling roller 31 at a low temperature.

Here, the amount of heat Q1 into the cooling roller 31 from one piece of recording sheet 15 is expressed by the formula:

$$Q1=W\times l\times h(T_{in}-T_c)\times L/v \quad (1)$$

wherein, W is a width of the recording sheet 15 with respect to a widthwise direction perpendicular to the sheet feed direction;

l is a length of a contact area of the cooling roller 31 (width of the nip portion 33) which the recording sheet 15 contacts with respect to the sheet feed direction;

h is a cooling capacity (W/(m$^2$·° C.)) of the cooling roller 31;

$T_{in}$ is a temperature of the recording sheet 15 when entering the nip portion 33;

$T_c$ is a temperature of the cooling roller 31 during the time when the fixing is operated;

L is a length of the recording sheet 15 with respect to the sheet feed direction; and v is a peripheral velocity of the cooling roller 31.

Here ($h(T_{in}-T_c)$) indicates thermal flux from the recording sheet 15 to the cooling roller 31, which is defined in the same manner as the thermal conductivity.

On the other hand, the amount of heat Q2 removed from the recording sheet 15 is calculated based on the temperature decrease by the formula:

$$Q2=\rho\times C\times\delta\times L\times W(T_{in}-T_{out}) \quad (2)$$

wherein ρ is a density (kg/m$^3$) of the recording sheet 15;

C is a specific heat ((J/kg·° C.)) of the recording sheet 15;

δ is a thickness of the recording sheet 15;

L is the length of the recording sheet 15 in the sheet feed direction;

W is the width of the recording sheet 15 with respect to a direction perpendicular to the sheet feed direction;

$T_{in}$ is a temperature of the recording sheet 15 when entering the nip portion 33; and $T_{out}$ is a temperature of the recording sheet 15 when discharged from the nip portion 33.

Because Q1 is equal to Q2, the following equation is derived from the above equations (1) and (2):

$$(T_{in}-T_{out})/(T_{in}-T_c)=(l\times h)/(\rho\times C\times\delta\times v) \quad (3)$$

Here, $T_{in}>T_{out}>T_c$.

Dimensionless temperature coefficient for evaluating the performance of the cooling roller 31 is set to $(T_{in}-T_{out})/(T_{in}-T_c)$, and the temperature coefficient is defined as θ, that is, $\theta=(T_{in}-T_{out})/(T_{in}-T_c)$.

Temperature $T_r$ of atmosphere surrounding the cooling roller 31 (hereinafter referred to as "atmosphere temperature $T_r$ of the cooling roller 31") is ruled by the temperature of the recording sheet 15 and falls between the temperatures $T_{in}$ and $T_{out}$ ($T_{in}>T_r>T_{out}$). The moisture content of the atmosphere surrounding the cooling roller 31 is less than the saturated vapor amount for the temperature $T_r$. If the moisture content of the atmosphere surrounding the cooling roller 31 is less than the saturated vapor amount for the temperature $T_c$ of the cooling roller 31, then dew condensation does not occur on the cooling roller 31. That is, dew condensation occurs less likely if the temperature $T_c$ is higher. Since increasing the temperature $T_c$ decreases the cooling capacity of the cooling roller 31, it is desirable to set the temperature $T_c$ high while keeping a proper balance with the cooling capacity of the cooling roller 31.

As described above, if the temperature $T_c$ is equal to or greater than 100° C., then the saturated vapor pressure is greater than the atmospheric pressure, and thus no dew condensation occurs. However, it is possible to prevent dew condensation even when the temperature $T_c$ is set less than 100° C. That is, the moisture content of the recording sheet 15 is several percents at most. Even if the moisture evaporates during the fixing operation, vapor amount in the atmosphere does not increase to the saturated vapor amount for the temperature $T_r$, but to a saturated vapor amount for a certain temperature $T_w$, which is less than the temperature $T_r$. Therefore, it is possible to set the temperature $T_c$ of the cooling roller 31 lower than the atmospheric temperature $T_r$ as long as the temperature $T_c$ is higher than the temperature $T_w$. Because the temperature $T_w$ is found 85° C. through experiments in this embodiment, the temperature $T_c$ of the cooling roller 31 is set to 85° C.

In this embodiment, the recording sheet 15 has the temperature $T_o$ of 130° C. immediately after being discharged from the fixing rollers 20, and the temperature $T_{in}$ of 126° C. The cooling roller 31 maintained at the temperature $T_c$ of 85° C. decreases the temperature of the recording sheet 15 by 30° C. to have the temperature $T_{out}$ of 96° C. This enables the recording sheet 15 to have a temperature $T_s$ of 57° C. when reaching the sheet stacker 40. Because 57° C. is lower than the glass transition temperature 60° C. of the toner, the toner stick problem can be prevented.

Here, according to the above formula (3), the temperature coefficient θ is 0.73 in this example.

As described above, according to the present embodiment, it is possible to make the temperature $T_s$ of the recording sheet 15 less than the glass transition temperature of 60° C. Therefore, there is no danger of toner stick. Also, because the temperature $T_c$ of the cooling roller 31 is set equal to or greater than the temperature $T_w$ of 85° C., it is possible to prevent dew condensation on the cooling roller 31. Further, there is no need to provide a mechanism to supply the cooling roller 31 with outside air so as to maintain the cooling roller 31 at relatively high temperature $T_c$ of 85° C., but only the ventilation fan 34 is used. Accordingly, a compact-sized cooling device 30 can be provided.

Setting the temperature coefficient θ of the above equation (3) to a higher value enables to set the temperature $T_c$ of the cooling roller 31 to a higher temperature, giving leeway regarding dew condensation, although it is necessary in this case to decrease the sheet transport speed v, to use a recording sheet with less density ρ, specific heat C, or thickness δ, or to increase the parameter l or h. Increasing the width l of the nip portion 33 is practical.

As described above, according to the present embodiment, dew condensation and toner stick problem are both prevented if the temperature $T_c$ of the cooling roller 31 is set higher than the temperature $T_w$ and also if the temperature coefficient of the cooling roller is set to 0.73 or greater. Because the temperature $T_w$ differs depending on the specifications of the image forming device, it is necessary to obtain the temperature $T_w$ beforehand through experiments.

While some exemplary embodiments of this invention have been described in detail, those skilled in the art will recognize that there are many possible modifications and variations which may be made in these exemplary embodiments while yet retaining many of the novel features and advantages of the invention.

What is claimed is:

1. A cooling device used in an image forming device that forms images on a recording medium and thermally fixes the images on the recording medium, the cooling device comprising:

a cooling roller;

a support member that contacts the cooling roller to define a nip portion between the cooling roller and the support member, wherein the cooling roller cools a recording medium at the nip portion between the cooling roller and the support member, a temperature of the cooling roller is set to 85° C. or greater.

2. The cooling device according to claim 1, wherein the temperature of the cooling roller is set to 100° C. or greater.

3. The cooling device according to claim 1, wherein a temperature coefficient of the cooling roller is set to 0.73 or greater, the temperature coefficient being equal to $(T_{in}-T_{out})/(T_{in}-T_c)$, wherein:

$T_{in}$ is a temperature of the recording medium when entering the nip portion;

$T_{out}$ is a temperature of the recording medium when leaving the nip portion; and $T_c$ is the temperature of the cooling roller.

4. The cooling device according to claim 1, wherein a temperature coefficient of the cooling roller is set to 0.73 or greater, the temperature coefficient being equal to $(l\times h)/(\rho\times C\times\delta\times v)$, wherein h is a cooling capacity of the cooling roller;

ρ is a density of the recording medium;

C is a specific heat of the recording medium;

δ is a thickness of the recording medium; and v is a peripheral velocity of the cooling roller.

5. The cooling device according to claim 1, wherein the temperature of the cooling roller is set equal to or greater than a minimum temperature at which dew condensation occurs.

6. The cooling device according to claim 1, further comprising a fan that discharges air from a region in the vicinity of the cooling roller, wherein the recording medium passes through the region.

7. The cooling device according to claim 6, further comprising a heat-radiation member that radiates heat of the cooling roller, wherein the air discharged from the region by the fan blows against the heat-radiation member.

8. A cooling device used in an image forming device that forms images on a recording medium and thermally fixes the images on the recording medium, the cooling device comprising:

a cooling roller;

a support member that contacts the cooling roller to define a nip portion between the cooling roller and the support member, wherein the cooling roller cools a recording medium at the nip portion between the cooling roller and the support member, and a temperature coefficient of the cooling roller is set to 0.73 or greater, the temperature coefficient being equal to $(T_{in}-T_{out})/(T_{in}-T_c)$, wherein:

$T_{in}$ is a temperature of the recording medium when entering the nip portion;

$T_{out}$ is a temperature of the recording medium when leaving the nip portion; and $T_c$ is the temperature of the cooling roller.

9. An image forming device comprising:

an image forming unit that forms images on a recording medium;

a fixing unit that thermally fixes the images on the recording medium; and a cooling device that cools the recording medium, the cooling device including a cooling roller and a support member that contacts the cooling roller to define a nip portion between the cooling roller and the support member, wherein the cooling roller cools a recording medium at the nip portion sandwiched between the cooling roller and the support member, a temperature of the cooling roller is set to 85° C. or greater.

10. The image forming device according to claim 9, wherein the temperature of the cooling roller is set to 100° C. or greater.

* * * * *